United States Patent [19]

Tyrrell

[11] 4,019,528

[45] Apr. 26, 1977

[54] FLUID MIXING APPARATUS

[75] Inventor: James Robert Tyrrell, Bloomington, Minn.

[73] Assignee: Anton Braun, Minneapolis, Minn.

[22] Filed: July 23, 1975

[21] Appl. No.: 598,204

[52] U.S. Cl. ..... 137/209; 137/403; 137/572

[51] Int. Cl.[2] ..... B67D 5/04

[58] Field of Search ..... 137/205.5, 206, 209, 137/101.25, 572, 403

[56] References Cited

UNITED STATES PATENTS

| | | | |
|---|---|---|---|
| 1,577,157 | 3/1926 | Averill | 137/101.25 |
| 1,680,103 | 8/1928 | Hardy | 137/101.25 |

*Primary Examiner*—Alan Cohan
*Attorney, Agent, or Firm*—Alan M. Staubly

[57] ABSTRACT

Apparatus for mixing fluids at a fixed ratio. It includes a large tank for the mixture, a storage tank for an additive fluid and preferably, an intermediate tank having a volume at least equal to the amount needed to provide the desired ratio when the large tank is completely filled with the larger volume of fluid and the additive from the intermediate tank. A stand pipe in the large tank and pipes and valves between the tanks are arranged to enable the introduction of the main fluid into the large tank, through a fill valve, to simultaneously displace a proportional amount of additive fluid into the large tank by the action of the main fluid rising in the stand pipe. An interlock arrangement between the fill valve and the other valves assures proper refilling of the large tank with the correct mixture.

3 Claims, 2 Drawing Figures

FLUID MIXING APPARATUS

Apparatus for mixing two or more fluids at a fixed ratio are generally well known. They have been as simple as the use of different sized measuring cups for the different fluids, for pouring the fluids into a common tank, or by using different sized constant volume pumps driven at the same speed for delivering the fluids to a common tank.

The present invention, while usable in various applications, is particularly adapted for metering an engine fuel additive into a fuel tank of a motor vehicle, as fuel is being supplied to the tank, and at a fixed ratio. Interlocking control means in the apparatus assures fool proof operation of the apparatus.

Figure 1:
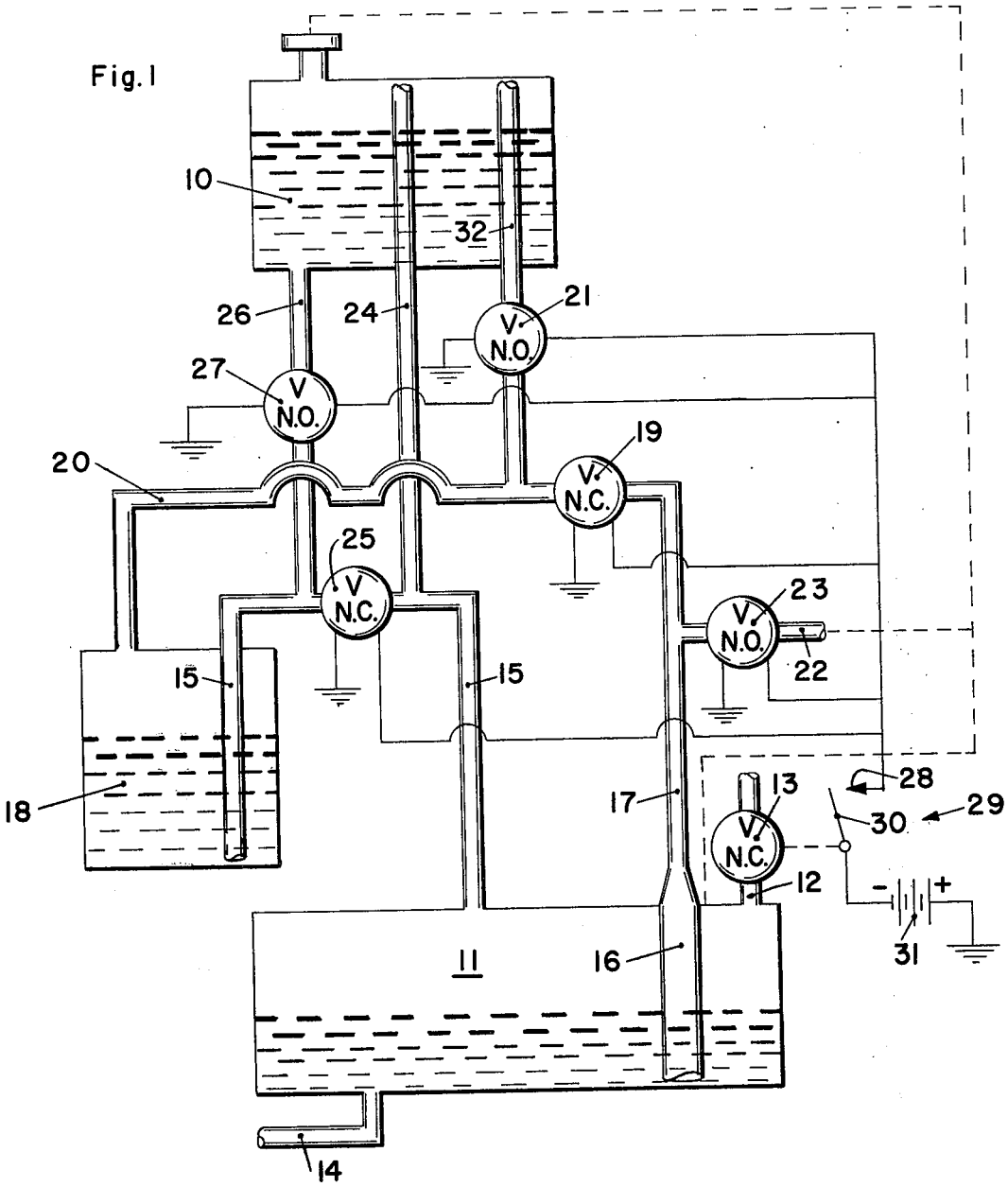
Figure 2:
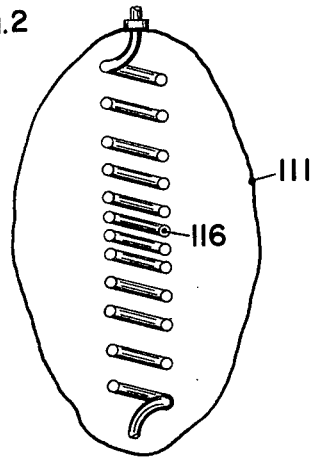

FIG. 1 of the drawing is a schematic showing of the one embodiment of the invention; and FIG. 2 is a modified form of a stand pipe.

As disclosed in FIG. 1, a relatively large tank 11, such as a fuel tank of an automobile and, particularly, a truck, has a fill pipe 12 with a normally closed valve 13 therein which has suitable venting means (not shown) to allow air vapor or gas to escape when the valve is open and fuel is entering tank 11. The bottom of the tank is adapted to be connected to an engine (not shown) by a pipe 14. A delivery pipe or conduit 15 preferably extends from the top of tank 11 to a point near the bottom of a tank 18 for containing an engine additive to be mixed with the engine fuel, such as diesel oil. One such additive is mixed with the fuel at a ratio of one part additive to three-thousand parts fuel and it is desirable to maintain that ratio all of the time.

To maintain the above or any other mixture ratio and assure that no attempt is made to add fuel to the fuel tank without mixing with it the proper quantity of additive, a stand pipe 16 having a cross-sectional inside area which, when compared with the fuel tank area excluding the stand pipe area at all fuel levels is substantially equal to the desired additive to fuel ratio, extends from the top of the fuel tank to a point near the bottom thereof. A small diameter pipe 17 extends from the top of the stand pipe to the top of container 18 through normally closed valve 19. Container 18 is preferably of a size just sufficient to hold the amount of additive needed to mix with a full tank of fuel, but may be much larger if a storage tank 10 is not provided. A vent pipe 20 extends from the top of container 18 through a normally open valve 21 to a vent pipe 32 or to the atmosphere or a common pressure in the system. A vent pipe 22 extends from pipe 17 to the atmosphere or a common pressure in the system and has a normally open valve 23 therein. A vent pipe 24 extends from the upper portion of tank 10 to either side of a normally closed valve 25 in pipe 15. A pipe 26 extends from the bottom of storage tank 10 to pipe 15 through valve 27 therein or to container 18.

All of the values except valve 13 are illustrated as being of the electrically actuated type, each of which is grounded and connected by wires to a common fixed contact 28 of a switch 29. A movable contact 30 of the switch is operably connected to valve 13 so that when the valve is opened, contact 30 engages fixed contact 28 to complete circuits from a grounded battery 31 to each of the electrically operated valves to reverse the on and off conditions thereof.

The apparatus is illustrated as being in an operating or non-refueling condition. This means that the electrically operated valves are not energized and additive is free to fill container 18 through pipe 26, valve 27 and pipe 15, valves 19 and 25 being closed. Air, vapor or gas can also enter pipe 22 and flow through open valve 23, pipe 17 and stand pipe 16 as fuel leaves tank 11 to the engine.

When it is desirable to fill the fuel tank, valve 13 has to be moved to its open position, which closes switch 29 and energizes all of the electrically operated valves. This closes valves 21, 23 and 27, and opens valves 19, and 25. Then as fuel enters tank 11, it will rise in the stand pipe and displace air, vapor or gas therein through pipe 17 and valve 19 and pipe 20 into container 18. Since valve 21 is energized and closed, an equal amount of additive will be forced through pipe 15 and valve 25 into the fuel tank. A stand pipe 24 between pipe 15 and the upper portion of tank 10 will break the syphoning effect and prevent additive in excess of the air displaced in pipe 16 to be drawn from tank 18. It is thus seen that no matter how empty the tank was or how full the tank is filled, the proper amount of additive is added to the fuel to maintain the desired ratio.

In some applications of the invention, as when an oval or round fuel tank is used, shown at 111 in FIG. 2, a coil type of stand pipe may be used with the coils closer together in the middle than at the top and bottom, to give the proper air, vapor or gas displacement at each level of fuel. A similar modification of the stand pipe 16 in FIG. 1 would be to place a bulge in the middle of the pipe for use in an oval or round tank.

Should it be desirable to eliminate the storage tank 10, valves 21 and 27, pipe 26 and stand pipe 32 would no longer be needed. A pressure tight fill cap having means connecting container 18 to a common pressure in the system, would have to be provided for tank 18 and stand pipe 24 would have to be higher than the highest fluid level. Pipe 24 could also be omitted if tank 10 is omitted. It is believed that the use of container 18 along with storage tank 10 provides a more sensitive arrangement than using only a large container 18.

The tanks 10 and 18 could be located any place, even below tank 11, if pipe 15 discharged into another container from which a pump could deliver the displaced additive to tank 11.

As other modifications of the invention, such as the use of a mechanical interlock between the fill valve and the other valves, which could be a mechanical linkage, or a pneumatic or hydraulic means rather than the electrical interlock, or the combining of two or more of the valves into a single unit, may be used, the scope of the invention should be determined from the appended claims.

I claim:

1. Fluid mixing apparatus comprising a tank for a first fluid, a container for receiving a second fluid, dispensing means having a first portion extending from a point at or near the bottom of said container to said tank and a second portion extending from a point at or near the bottom of said tank to the top portion of said container, an opening for filling said tank, a normally closed first valve in said opening, a normally closed second valve in the first portion of said dispensing means, interlock means between said first and second valves to cause them to open and close substantially simultaneously, first and second vent means leading from said second portion of said dispensing means at points between said tank and said container, a normally open third valve in the first of said vent means that is operably connected to said interlock means so as to close when said first valve opens, a storage tank for said second fluid with a refill conduit extending between it and said container, a normally open fourth valve located in said refill conduit, a normally open fifth valve located in the second of said vent means, a normally closed sixth valve in said second portion of said dispensing means between said first and second vent means, said fourth, fifth and sixth valves being operably connected to said interlock means so as to move to their other positions when said first valve is opened.

2. Fluid mixing apparatus as defined in claim 1 wherein said interlock means includes electrical means

3. Fluid mixing apparatus as defined in claim 2 wherein said second, third fourth, fifth and sixth valves are electrically operated valves.

* * * * *